United States Patent [19]

Gartner

[11] Patent Number: 4,523,518

[45] Date of Patent: Jun. 18, 1985

[54] APPARATUS FOR CONTROLLING TEMPERATURE IN A UNIT TYPE CURTAIN WALL

[75] Inventor: Karl Gartner, Gundelfingen, Fed. Rep. of Germany

[73] Assignee: Yoshida Kogyo K.K., Tokyo, Japan

[21] Appl. No.: 519,200

[22] Filed: Aug. 1, 1983

[30] Foreign Application Priority Data

Aug. 2, 1982 [JP] Japan ..... 57-133764

[51] Int. Cl.[3] ..... F24F 7/10

[52] U.S. Cl. ..... 98/31; 52/235; 165/50; 237/46; 237/56

[58] Field of Search ..... 237/46, 56; 98/31, 33 R, 98/40 R, 40 C; 165/50, 83; 138/111, 112; 285/188; 52/219, 573, 209, 302, 235

[56] References Cited

U.S. PATENT DOCUMENTS

| | | | |
|---|---|---|---|
| 3,780,638 | 12/1973 | Burghartz et al. | 98/31 |
| 3,905,548 | 9/1975 | Brodie | 98/31 X |
| 4,103,598 | 8/1978 | Cooper | 237/50 X |
| 4,184,298 | 1/1980 | Balzer et al. | 52/573 X |
| 4,203,487 | 5/1980 | Gartner | 98/31 X |

FOREIGN PATENT DOCUMENTS

| | | | |
|---|---|---|---|
| 2020643 | 11/1971 | Fed. Rep. of Germany | 98/31 |
| 2559412 | 2/1977 | Fed. Rep. of Germany | 52/219 |

*Primary Examiner*—Harold Joyce

*Attorney, Agent, or Firm*—Hill, Van Santen, Steadman & Simpson

[57] ABSTRACT

An apparatus for controlling temperature in a unit type curtain wall for arraying the outside of a building wherein pipings within the body of the building can be minimized and the air conditioning effect at the window can be sufficiently achieved. The temperature control apparatus comprises vertical and horizontal frame members having hollow portions as air flowing passages through which conditioned air flows, wherein respective hollow portions of the vertical frame members adjacent to left and right and opposite to top and bottom at their respective one ends are respectively arranged at opposed top and bottom ends in such a manner of allowing them to communicate with each other only in relation to top and bottom by the interposition of cylindrical connecting members thereby forming vertically communicating air flowing ducts, respectively, which are independent of each other to left and right.

8 Claims, 6 Drawing Figures

APPARATUS FOR CONTROLLING TEMPERATURE IN A UNIT TYPE CURTAIN WALL

BACKGROUND OF THE INVENTION

1. Field of the Invention

This invention relates to an apparatus for controlling temperature in a building whose outside wall is arrayed with a unit type curtain wall, and more particularly to a special unit type curtain wall including an air conditioning system for cooling and heating a room.

2. Description of the Prior Art

In the past, a temperature control apparatus in a building generally known is mainly constructed in such a manner that conduits such as, for example, ducts which reach the interior of the ceiling of each room through a body of the building are disposed. Then, heating air or cooling air is fed into the conduits by means of a blower so that conditioned heated or cooled air is supplied into the interior of a room through air blowing-off openings properly distributed and suitably provided in each room of the building.

However, in such a temperature control apparatus, conditioned air can be spread substantially uniformly over the interior of a room, but the neighbourhood of portions where a window is opened tends to be affected by temperature of open air, the sunlight or the like, resulting in an insufficient air conditioning effect at such portions. To overcome this disadvantage, end devices can be installed at the window of the room. With this arrangement, however, a water piping and an air piping are to be installed for each end device with the result that there poses disadvantages in that such pipings are not only cumbersome but also particular spaces for installation of the end devices are required, and thus a floor surface cannot be used effectively.

SUMMARY OF THE INVENTION

Under the foregoing circumstances, the present invention has been made, and it is a primary aspect of the present invention to provide a temperature control apparatus utilizing a unit type curtain wall wherein piping within the body of the building can be minimized and the air conditioning effect at the window can be sufficiently achieved.

It is another aspect of the present invention to provide a temperature control apparatus in a unit type curtain wall wherein an effective using area of a floor in the room is widely provided without particular provision of a space for installation of an end device on or in the floor.

It is a further aspect of the present invention to provide a temperature control apparatus in a unit type curtain wall wherein, even if a relative storey displacement or other displacements between associated unit curtain wall units adjacent to one another occurs due to earthquakes, errors in execution of the building, etc. or thermal expansion and contraction or the like resulting from a difference between a temperature of open air and that of the interior of a room or the like, air-tight communication between upper and lower hollow portions which are air flowing passages of upper and lower vertical frame members of the unit type curtain wall can be maintained whereby the vertical frame members in the curtain wall can be utilized as upper and lower communicating ducts through which conditioned air flows.

It is a further aspect of the present invention to provide a temperature control apparatus in a unit type curtain wall wherein upper and lower hollow portions, which are respective air flowing passages of four vertical frame members constituting a mullion-like portion and being adjacent to left and right and opposite to top and bottom at their respective one ends and extending in parallel with a set of two sides thereof, can be positively connected air-tightly by simple constructed cylindrical connecting members, respectively.

It is a still further aspect of the present invention to provide a temperature control apparatus in a unit type curtain wall wherein a wall member for partitioning the room can be provided while adjusting the adjacent vertical frame members which are the said mullion-like portion, whereby adjacent rooms are formed with using the partitioning wall as a boundary, a supply of cooled or heated air to each room can be accomplished simply and adequately.

In order to achieve the foregoing aspects, according to the present invention, there is provided an apparatus for controlling temperature in a unit type curtain wall, the curtain wall being formed with a plurality of curtain wall units each having a substantially square skeleton in which a plurality of horizontal frame members are horizontally connected between left and right vertical frame members, and said curtain wall units being arranged to top and bottom and to left and right, characterized in that said vertical frame members and said horizontal frame members have respectively hollow portions which are air flowing passages through which conditioned air is made to flow so as to blow said conditioned air into a room through air blow-off openings formed in said horizontal frame members, and that respective hollow portions of the vertical frame members adjacent to left and right and opposite to top and bottom at their respective one ends are respectively arranged at opposed top and bottom ends in such a manner of allowing them to communicate with each other only in relation to top and bottom by cylindrical connecting members thereby forming vertically communicating air flowing ducts, respectively, which are independent of each other to left and right.

According to the present invention, there is further provided an apparatus for controlling temperature in a unit type curtain wall wherein the said cylindrical connecting members are made of a flexible material.

Further, according to the present invention, there is provided an apparatus for controlling temperature in a unit type curtain wall wherein the said flexible cylindrical connecting members are fixedly secured to the vertical frame members having the relation to top and bottom by means of bands.

Further, according to the present invention, there is provided an apparatus for controlling temperature in a unit type curtain wall wherein the said hollow portions as vertical communicating air flowing ducts respectively formed in the vertical frame members are allowed to communicate with at least one of the said hollow portions formed in the horizontal frame members, respectively.

Further, according to the present invention, there is provided an apparatus for controlling temperature in a unit type curtain wall wherein the said one of the hollow portions of the horizontal frame members is an intermediate transom.

Further, according to the present invention, there is provided an apparatus for controlling temperature in a unit type curtain wall wherein the said vertical and horizontal frame members further comprises small-sized hollow portions which are passages through which heating or cooling medium flows and respectively formed to be adjacent to the said hollow portions each serving as an air flowing passage.

Further, according to the present invention, there is provided an apparatus for controlling temperature in a unit type curtain wall wherein respective heating or cooling medium flowing passages of one of the vertical frame members, an upper horizontal frame member, the other vertical frame member and a lower horizontal frame member are, in turn, allowed to communicate with one another so as to form a heating or cooling medium flowing line.

Further, according to the present invention, there is provided an apparatus for controlling temperature in a unit type curtain wall wherein one end of the said heating or cooling medium flowing line is connected through a pipe to a heating or cooling medium supply conduit, and wherein the other end thereof is connected through another pipe to a heating or cooling medium return conduit.

Further, according to the present invention, there is provided an apparatus for controlling temperature in a unit type curtain wall wherein a pair of vertical frame members adjacent to left and right connected with each other through packing bands fitted between and into recesses respectively formed in the said pair of vertical frame members in such a manner of opposing to each other, thereby enabling to absorb a relative displacement caused between curtain wall units adjacent to left and right.

Still further, according to the present invention, there is provided an apparatus for controlling temperature in a unit type curtain wall wherein the said air flowing passages of the lowermost vertical frame members are connected to a blower.

BRIEF DESCRIPTION OF THE DRAWINGS

The above and many other advantages, features and additional aspects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

An embodiment of the present invention will noe be described with reference to the accompanying drawings.

Figure 1:
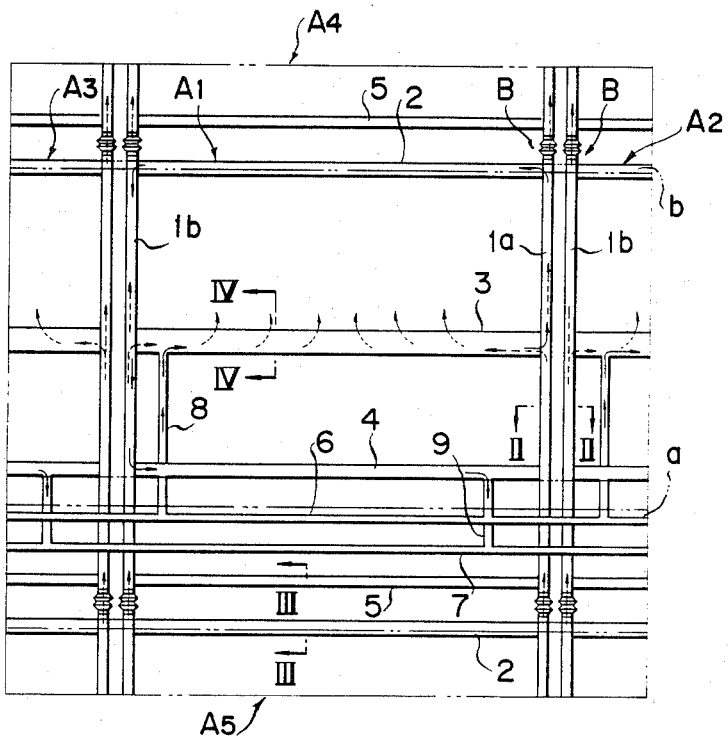
FIG. 1 is a partical front view showing only the skeleton of a curtain wall.

FIG. 1 is a partial front view showing only a skeleton of a curtain wall. The curtain wall has a construction in which a plurality of curtain wall units are continuously mounted at top and bottom and to left and right. Each unit curtain wall unit is mounted while being bridged between a floor a and a ceiling b.

Each unit curtain wall unit comprises a substantially square skeleton in which an upper cross beam 2 serving as one of a horizontal frame members, an intermediate transom 3, a lower cross beam 4 and a lower frame 4 are horizontally connected between the pair of left and right vertical frame members 1*a*, 1*b*, and the vertical frame members 1*a*, 1*b* for the vertically continuous curtain walls units $A_1$, $A_4$ are connected through connecting devices B. A supply conduit 6 for a heating or cooling medium such as hot water and cool water and a return conduit 7 are laterally and continuously connected between the floor a and the ceiling b in each floor.

Figure 2:
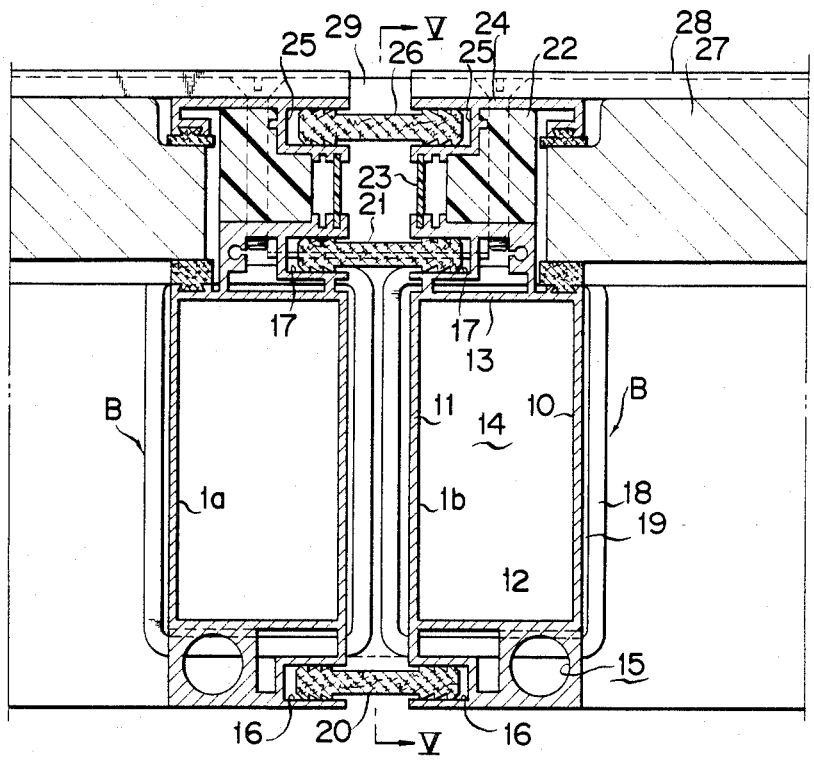
FIGS. 2, 3 and 4 are sectional views taken on line II—II, III—III and IV—IV, respectively, of FIG. 1.

FIG. 2 is a sectional view taken on line II—II of FIG. 1. The vertical frame member 1*a* or 1*b* comprises a hollow lengthy member composed of left and right longer side walls 10, 11 and inner and outer shorter side walls 12, 13 to form a hollow portion 14 serving as an air flowing passage, the inner shorter side wall 12 being formed with a small hollow portion 15 serving as a heat or cool medium flowing passage and a recess 16, while the outer wall 13 being formed with a recess 17.

Figure 3:
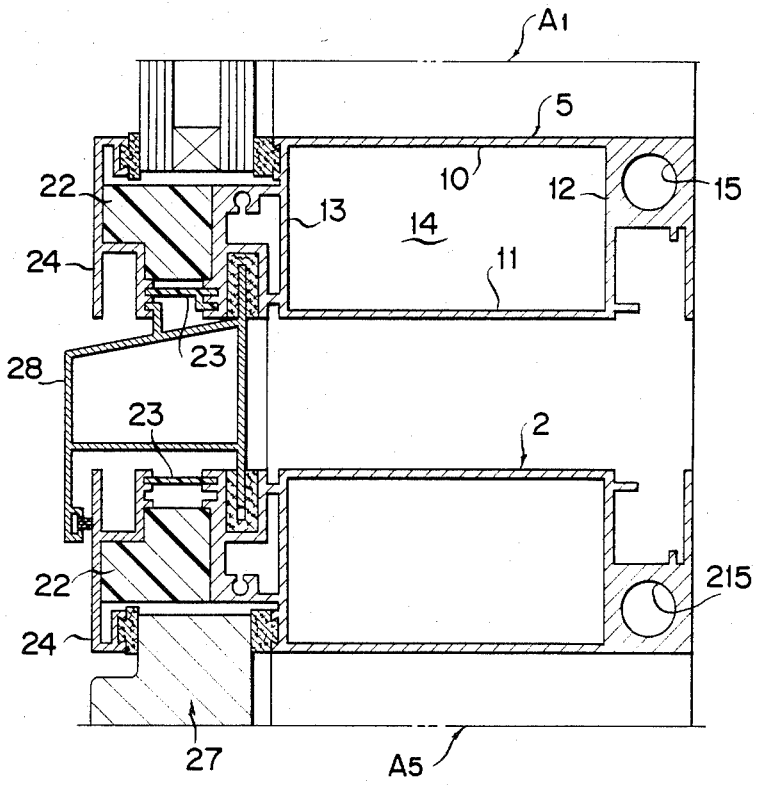

Also, as shown in FIG. 3, the lower frame 5 and the upper cross beam 2 have substantially the same shape as that of the vertical frame member 1*a* or 1*b* and are disposed with top and bottom inverted and opposed to each other. Battens 24 are mounted on the outer shorter side wall 13 through a heat insulating material 22 and a connecting plate 23 of a heat insulating material and the lower frame 5 and a portion outside the room of the upper cross beam 2 and the battens 24, 24 are connected by flashing members 28 as a connecting plate.

Figure 4:
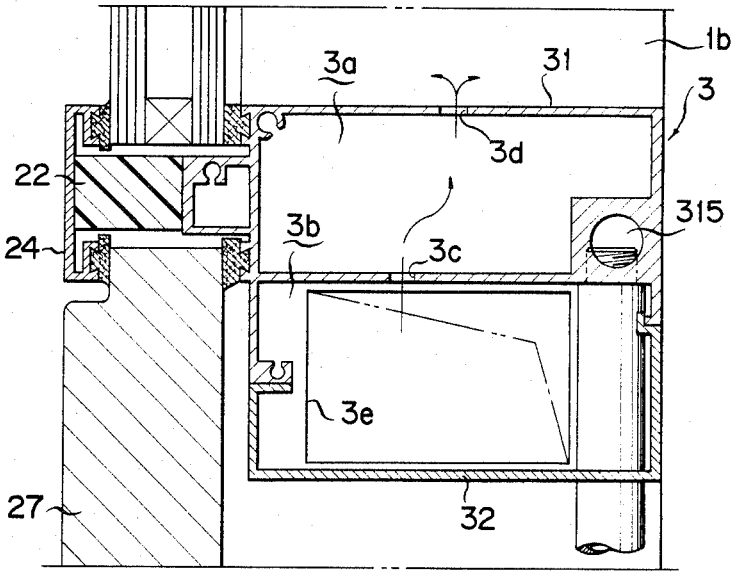

In the intermediate transom 3, as shown in FIG. 4, an upwardly directed cover member 32 of the upward C-shape is connected to a body 32 of the intermediate transom 3 having substantially the same shape as that of the vertical frame member to form the first and second hollow portions 3*a* and 3*b* at top and bottom, respectively. The second hollow portion 3*b* is allowed to communicate at the longer side wall of the vertical frame member 1*a* or 1*b* with the hollow portion 14 serving as the air flowing passage of the vertical frame member 1 through the opening 3*e* provided in the position opposed to the second hollow portion 3*b*. The second hollow portion 3*b* is allowed to communicate with the first hollow portion 3*a* via the hole 3*c*, while the first hollow portion 3*a* is open into the room from the air blow openings 3*d*.

Figure 5:
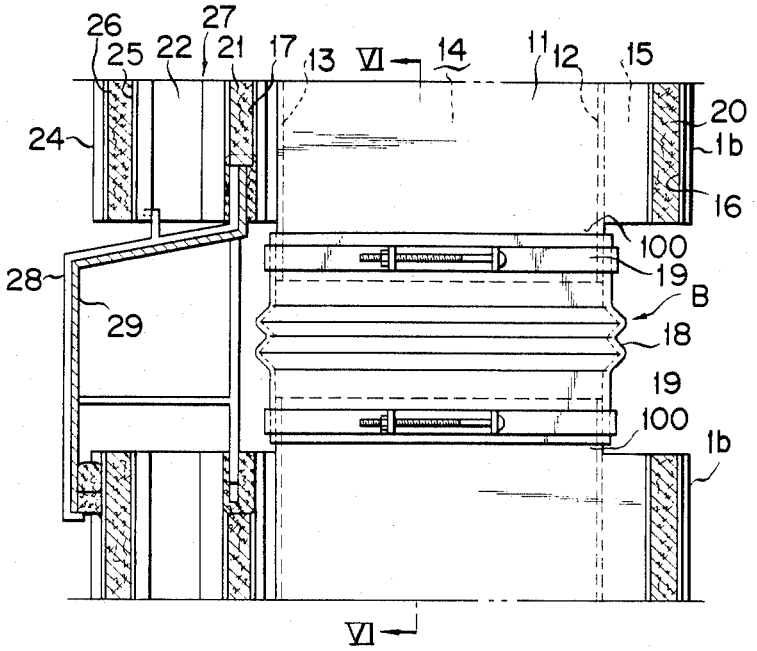
FIG. 5 is a sectional view taken on line V—V of FIG. 2.
Figure 6:
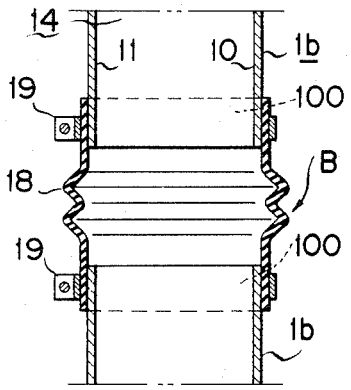
FIG. 6 is a sectional view taken on line VI—VI of FIG. 5.

As shown in FIGS. 5 and 6, the small hollow portion 15 serving as the heating medium flowing passage, the recess 16 and the recess 17 are cut away in the shorter side wall portions of upper and lower ends of the vertical member 1*a* or 1*b*, but the inner and outer shorter side walls 12, 13 are left. As a result, the left and right longer side walls 10, 11 and the inner and outer shorter side walls 12, 13 constitute outer peripheral wall 100 having a substantially rectangular section, and a flexible cylindrival connecting member 18 is fastened by means of fastening bands 19, 19 between the outer peripheral walls 100, 100 vertically opposed to manitain air-tight the hollow portion 14 which may be displaced between the upper and lower vertical frame members 1*a*, 1*b* (or 1*a*,1*a*) and serves as the air flowing passage.

That is, the cylindrical connecting member 18 and the fastening bands 19, 19 constitute the connecting device B.

With this arrangement, air may flow between the vertical frame members 1*b*, 1*b* or 1*a*, 1*a* of the upper and lower curtain walls $A_1$, $A_4$. Further, the portion between the vertial frame members can be displaced also.

Returning now to FIG. 2, the vertical frame members 1*a*, 1*b* adjacent to left and right are connected through packing bands 20, 21, 26 respectively fitted between respective pairs of the recesses 16, 16; 17, 17 adn 25, 25 which are opposed to each other. The unit curtain wall units $A_1$, $A_2$ adjacent to left and right can absorb a relative displacement by movement of the bands into and out of the portion where the packing bands are fitted.

It should be noted that if a sectional area of the hollow portion 14 serving as the air flowing passage of the vertical frame member 1*a* or 1*b* is small instead of a size required to feed air for feeding each of the floors, a cross section of the vertical frame member 1*a* or 1*b* can be made larger to increase a sectional area of the hollow portion 14 serving as the air flowing passage. This is preferable because the strength of the vertical frame member increase to increase the strength of the curtain wall.

In FIG. 1, the cross beam 2, the intermediate transom 3, the lower cross beam 4 and the lower frame 5 have substantially the same shape as that of the vertical frame member and respectively connected at their respective both ends to the vertial frame members 1*a* and 1*b*. As shown in FIG. 4, the hollow portion 14 serving as the air flowing passage of the vertical frame member 1*a* or 1*b* and the hollow portion 3*a* serving as the air flowing passage of the intermediate transom 3 are brought into communication with each other through an opening 3*e* of said vertical frame members 1*a*, 1*b*. The hollow portion 3*a* of the intermediate transom 3 is open into the room via an air blowing-off openings 3*d*. The hollow portions 15, 15 serving as the heating or cooling medium flowing passages of the vertical frame members 1*a*, 1*b* are in communication with both ends of the hollow portion 215 serving as the heating or cooling medium flowing passage of the upper cross beam 2, while the hollow portion 15 serving as the heating cooling medium flowing passage of one vertical frame member 1*a* is in communication with the heating or cooling medium flowing passage 315 of the intermediate transom 3, and the hollow portion 15 serving as the heating or cooling medium flowing passage of the other vertical frame member 1*b* is in communication with the hollow portion (not shown) serving as the heating or cooling medium flowing passage of the lower cross beam 4. Further, upper and lower sides of the hollow portions 15, 15 serving as the heating or cooling medium flowing passages of the vertical frame member 1*a*, 1*b* may be blocked by means of blind plugs not shown, and the other end of the hollow portion serving as the heating or cooling medium flowing passage of the intermediate transom 3 and the lower cross beam 4 is also blocked.

That is, the respective heating or cooling medium flowing passages for the intermediate transom 3, one vertical frame member 1*a*, the upper cross beam 2, the other vertical frame member 1*b* and the lower cross beam 4 are in communication to constitute a heating or cooling medium flowing line continuous to each curtain wall unit, as shown by full line arrows in FIG. 1.

The heating or cooling medium flowing passage of the intermediate transom 3 is connected to and allowed to communicate with the supply conduit 6 via a pipe 8, and the heating or cooling medium flowing passage of the lower cross beam 4 is connected to and allowed to communicate with the return conduit 7 via a pipe 9. The air flowing passages of the lowermost vertical frame members 1*a*, 1*b* are connected to and allowed to communicate with a blower or the like.

The heating or cooling medium supplied from the supply conduit 6 heats or cools, in turn, the respective vertical and horizontal frame members 3, 1*a*, 2, 1*b* and 4 during the time the medium is flowing through said heating or cooling medium flowing passage to control temperatures in the rooms by the radiation effects from the vertical and horizontal frame members, and at the same time, conditioned air which has been cleaned and adjusted in temperature and humidity is fed into the air flowing passages 3*b*, 3*a* of the horizontal frame members such as the intermediate transom 3 from the hollow portion 14 serving as the air flowing passage of the vertical frame members 1*a*, 1*b*, and the air is then blown into the room from the air blow openings 3*d* provided in plural number longitudinally of the intermediate transom 3 to provide said radiation effect and to ideally control temperature over the wide range of the room starting the window.

Also, the heating or cooling medium can heat or cool the vertical frame members 1*a*, 1*b* and the intermediate transom 3 and auxiliarily can maintain the conditioned air which flow through the air flowing passages of the intermediate transom 3 and the vertical frame members 1*a*, 1*b* in a conditioned state.

In FIGS. 2 and 5, the vertical frame members 1*a*, 1*b* adjacent to left and right are connected and sealed by the inner and outer packing bands 20, 21 fitted for movement into and out of the portions between the opposed recesses 16, 16 and 17, 17. Further, battens 24 are mounted on the outer shorter side wall 13 of each vertical frame member 1*a* or 1*b* through a heat insulating member 22 and a heat insulating connecting plate 23. A packing band 26 is fitted between the recesses 25 of the opposed battens 24 in a manner similar to the first mentioned packing band, and a heat insulating panel 27 is mounted between the vertical frame member 1*a* and 1*b* and the batten 24. The flashing members 28 are mounted between upper and lower panels 27, 27, the left and right flashing members 28, 28 being associated by means of a connecting back plate 29.

As described above, in accordance with the present invention, the vertical frame member 1*a*, 1*b* and the horizontal frame members 2, 3 and 4 which constitute each curtain wall unit can be utilized to control temperature of the room. Therefore, the piping within the body of the building may be minimized. And, in addition, the temperature control device can be mounted at the same time when the unit curtain wall unit is mounted and when the mounting operation is very simple. Furthermore, ideal air conditioning can be effected at the window or from the wall surfaces, and the floor of the room can be effectively used without being narrowed by the air conditioning unit.

Moreover, the hollow portions, which are respective air flowing passages of four vertical frame members constituting a mullion-like portion and being adjacent to left and right and opposite to top and bottom at their respective one ends and extending in parallel with a set of two sides thereof, are separately connected to left and right by means of the flexible cylindrical connecting member in such a manner that, even if said hollow portions are in a relation adjacent to left and right, they are allowed to be independent of each other so as to communicate with each other at the ends thereof only in their top and bottom without arranging them into one body. Therefore, even if relative storey displacement or other displacements which are unavoidable between the connected unit curtain wall units adjacent to one another occurs due to earthquakes, errors in execution or thermal expansion and contraction or the like resulting from a difference between a temperature of open air and that of the interior of a room or the like, in the connection in a vertical direction for the crossed portion of the unit type curtain walls, the vertical and horizontal displacements can be absorbed by the said connected portions so as not to influence one movement on the other. Further, even between the curtain wall units adjacent to left and right, movement of one unit will not influence on the other so that the displacement between the curtain wall units can be absorbed without impairing air-tight communication between the upper and lower hollow portions serving as the air flowing passages of the vertical frame members to positively maintain the air-tight communication between the upper and lower hollow portions serving as the air flowing passages of the vertical frame members in the unit type curtain wall avoiding occurence of any air leak or the like even if the earthquake occurs. In addition, the upper and lower hollow portions, which are respective air flowing passages of four vertical frame members constituting a mullion-like portion and being adjacent to left and right and opposite to top and bottom at their respective one ends and extending in parallel with a set of two sides thereof, can be vertically positively brought into air tight communication by means of two simple cylindrical connecting members which are juxtaposed.

The vertical frame members adjacent to left and right of the mullion-like portion in the portion where the unit curtain wall units are associated to left and right respectively constitute an individual hollow air flowing passage and are made continuous only at top and bottom, and therefore, when the partitioning wall is built at the mullion-like portion in the indoor to feed cooled air or hot air into the adjacent rooms with said partitioning wall being a boundary, such air can be distributed and fed into the adjacent rooms since the air flowing passages of the left and right vertical frame members in the mullion-like portion are individually opposed to the rooms. Because of this, the cooled air and hot air in the amount more than that required will never be used, and a damper device or the like need not be provided to supply and distribute cooled air and hot air in the mullion-like portion but supplying of such air can be simply accomplished.

Accordingly, where a partitioning wall is provided in a room within a building while adjusting to adjacent vertical frame members which constitute the mullion-like portion thereby constituting adjacent rooms with the partitioning wall being a boundary, it is possible to supply and distribute cooled or hot air to the rooms in a simple and adequate manner.

That is, where the left and right hollow air flowing passages in the mullion-like portion including clearances and spaces thereof are placed in lateral communication to form a single enlarged air flowing passage so that a large quantity of air may be fed and such a large quantity of air has to be distributed to left and right, it can be considered that a damper device or the like is provided interiorly as necessary for distribution. However, this proposal results in inconveniences in that air distribution by use of the damper device or the like becomes not only cumersome but also complicate and expensive in its construction, and that it is extremely difficult to provide the air-tight connecting portion of the enlarged air flowing passage irrespective of earthquakes of the like. On the other hand, according to the present invention, there is provided an excellent air conditioning unit which effectively make use of the unit type curtain wall without involving the difficulties noted above.

It is to be understood that the foregoing description is merely illustrative of the preferred embodiments of the present invention and that the scope of the invention is not to be limited thereto. Additional modifications or alterations of the invention will ready occur to one skilled in the art without departing from the scope of the invention.

What is claimed is:

1. An apparatus for controlling temperature in a unit type curtain wall, the said curtain wall being formed with a plurality of curtain wall units each having a substantially square skeleton in which a plurality of horizontal frame members are horizontally connected between left and right vertical frame members, and the said curtain wall units being arranged at top and bottom and to left and right, characterized in that the said vertical frame members and the said horizontal frame members have hollow portions, respectively, which are air flowing passages through which conditioned air is made to flow so as to blow said conditioned air into a room through air blow-off openings formed in said horizontal frame members, and that respective hollow portions of the vertical frame members adjacent to left and right and opposite to top and bottom at their respective one ends are respectively arranged at opposed top and bottom ends in such a manner of allowing them to communicate with each other only in relation to top and bottom by the interposition of flexible cylindrical connecting members thereby forming vertically communicating air flowing ducts, respectively, which are independent of each other to left and right, said pair of vertical frame members adjacent to left and right are connected with each other through packing band means fitted between and into recesses respectively formed in the said pair of vertical frame members in such a manner of opposing to each other, thereby enabling to absorb a relative displacement caused between curtain wall units adjacent to left and right.

2. An apparatus for controlling temperature in a unit type curtain wall according to claim 1 wherein the said flexible cylindrical connecting members are fixedly secured to the vertical frame members having the relation to top and bottom by means of bands.

3. An apparatus for controlling temperature in a unit type curtain wall according to claim 1 wherein the said hollow portions as vertical communicating air flowing ducts respectively formed in the vertical frame members are allowed to communicate with at least one of the said hollow portions formed in the horizontal frame members, respectively.

4. An apparatus for controlling temperature in a unit type curtain wall according to claim 3 wherein the said one of the hollow portions of the horizontal frame members is an intermediate transom.

5. An apparatus for controlling temperature in a unit type curtain wall according to claim 1 wherein the said vertical and horizontal frame members further comprises small-sized hollow portions which are passages through which heating or cooling medium flows.

6. An apparatus for controlling temperature in a unit type curtain wall according to claim 1 or 5 wherein respective heating or cooling medium flowing passages of one of the vertical frame members, an upper horizontal frame member, the other vertical frame member and a lower horizontal frame member are, in turn, allowed to communicate with one another so as to form a heating or cooling medium flowing line.

7. An apparatus for controlling temperature in a unit type curtain wall according to claim 6 wherein one end of the said heating or cooling medium flowing line is connected through pipe means to a heating or cooling medium supply conduit, and wherein the other end thereof is connected through another pipe means to a heating or cooling medium return conduit.

8. An apparatus for controlling temperature in a unit type curtain wall according to claim 1 wherein respective air flowing passages of the lowermost vertical frame members are connected to blower means.

* * * * *